US012127624B2

(12) United States Patent
Bischofberger et al.

(10) Patent No.: US 12,127,624 B2
(45) Date of Patent: Oct. 29, 2024

(54) BICYCLE HELMET WITH EYEWEAR RETENTION

(71) Applicant: Specialized Bicycle Components, Inc., Morgan Hill, CA (US)

(72) Inventors: Allen Albert Bischofberger, Ben Lomond, CA (US); Luiz Felipe de Melo Dias, Minas Gerais (BR); Alexander Hart Jerome, Morgan Hill, CA (US); David Tyler Debus, Felton, CA (US); Christopher Thomas Pietrzak, Redwood City, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 148 days.

(21) Appl. No.: 17/948,810

(22) Filed: Sep. 20, 2022

(65) Prior Publication Data

US 2023/0101563 A1 Mar. 30, 2023

Related U.S. Application Data

(60) Provisional application No. 63/248,810, filed on Sep. 27, 2021.

(51) Int. Cl.
*A42B 3/18* (2006.01)
*A42B 3/06* (2006.01)
(Continued)

(52) U.S. Cl.
CPC ..... *A42B 3/185* (2013.01); *A42B 3/06* (2013.01); *A42B 3/28* (2013.01); *A42B 3/324* (2013.01)

(58) Field of Classification Search
CPC ..... A42B 3/28; A42B 3/281; A42B 3/283; A42B 3/14; A42B 3/18; A42B 3/324; A42B 3/185; G02C 3/02
See application file for complete search history.

(56) References Cited

U.S. PATENT DOCUMENTS 5,790,228 A 8/1998 Bell, III
6,481,059 B2 11/2002 Morris
(Continued)

FOREIGN PATENT DOCUMENTS

DE 102004063921 A1 5/2006
DE 202016104489 U1 9/2016
(Continued)

OTHER PUBLICATIONS

Amazon. Giro Synthe Helmet. Accessed on Jan. 31, 2016. Available online at https://web.archive.org/web/20160131212752/http://www.amazon.com/Giro-Synthe-Helmet/dp/B00MX3SR84 (5 pages).
(Continued)

*Primary Examiner* — Katherine M Moran
(74) *Attorney, Agent, or Firm* — Michael Best & Friedrich LLP

(57) ABSTRACT

A bicycle helmet adapted to be used with eyewear includes an impact-absorbing body, a resilient wiper, and an alignment feature. The impact-absorbing body has a convex exterior surface and a concave interior surface adapted to be positioned on a user's head. The impact-absorbing body further includes an aperture formed in the exterior surface and dimensioned to permit insertion of a portion of the eyewear into the aperture along an insertion axis. The resilient wiper is positioned at least partially in the aperture and arranged to engage the portion of the eyewear upon insertion into the aperture. The alignment feature defines at least a portion of the aperture and is oriented to guide the portion of the eyewear toward the resilient wiper.

16 Claims, 9 Drawing Sheets

(51) Int. Cl.
*A42B 3/28* (2006.01)
*A42B 3/32* (2006.01)

(56) References Cited

U.S. PATENT DOCUMENTS

| | | | | |
|---|---|---|---|---|
| 6,711,751 | B1 | 3/2004 | Muskovitz | |
| 7,865,976 | B2 | 1/2011 | Beddoe et al. | |
| 9,833,032 | B2 | 12/2017 | Jacobsen | |
| 9,848,664 | B2 | 12/2017 | Poldoski | |
| 10,564,444 | B2 * | 2/2020 | Clark | G02C 3/02 |
| 10,743,603 | B2 | 8/2020 | Mcdavitt | |
| 11,019,872 | B2 | 6/2021 | Calilung et al. | |
| 2004/0064873 | A1 | 4/2004 | Muskovitz | |
| 2006/0185051 | A1 * | 8/2006 | Teston | A42B 3/185 2/6.3 |
| 2018/0279709 | A1 | 10/2018 | Durham et al. | |
| 2020/0008506 | A1 * | 1/2020 | Hilles | A42B 1/02 |
| 2020/0305537 | A1 * | 10/2020 | Tan | A42B 3/283 |
| 2022/0039501 | A1 * | 2/2022 | Maltz | A42B 3/04 |
| 2023/0200479 | A1 * | 6/2023 | Plumb | A42B 3/185 2/10 |

FOREIGN PATENT DOCUMENTS

| | | | |
|---|---|---|---|
| EP | 3284360 | A1 | 2/2018 |
| EP | 3714722 | A2 | 9/2020 |
| JP | 3178391 | U | 9/2012 |
| KR | 20110007203 | U | 7/2011 |
| KR | 20110108167 | A | 10/2011 |
| KR | 20160076948 | A | 7/2016 |
| KR | 101986568 | B1 | 3/2019 |
| TW | M378649 | U | 4/2010 |

OTHER PUBLICATIONS

Bicycles Network Australia. KASK Valegro Helmet and KOO Open Cube Cycling Sunglasses in Review. Mar. 20, 2018. Available online at https://www.bicycles.net.au/2018/03/kask-valegro-helmet-and-koo-open-cube-cycling-sunglasses-in-review/ (11 pages).

Bike Radar. Giro Synthe Helmet Review. Oct. 21, 2014. Available online at https://www.bikeradar.com/reviews/helmets/road-cycling-helmets/giro-synthe-helmet-review/ (4 pages).

BrickSeek. Schwinn UXO Multisport Adult Helmet with Sunglass Holder. Accessed on Dec. 14, 2022. Available online at https://brickseek.com/target-inventory-checker?sku=082-01-1557 (4 pages).

Canadian Cycling Magazine. First Ride in Oakley Flight Jacket Sunglasses, ARO3 Helmet and Premium kit. May 31, 2018. Available online at https://cyclingmagazine.ca/sections/gear-reviews/oakley-flight-field-jacket-aro3-helmet-kit-review/ (5 pages).

Competitive Cyclist. Ventral Air Spin Helmet. Version dated Jun. 13, 2021. Accessed online at https://web.archive.org/web/20210613210241/https://www.competitivecyclist.com/poc-ventral-air-spin-helmet (17 pages).

CyclingTips.com. Oakley ARO5 Helmet Review: Feelin' hot, hot, hot. Version dated Feb. 27, 2021 at https://web.archive.org/web/20210227224443/https://cyclingtips.com/2018/06/oakley-aro5-helmet-review-feelin-hot-hot-hot/ (19 pages).

Giro Aether Spherical Adult Road Cycling Helmet. Version accessed on Aug. 15, 2020 at https://web.archive.org/web/20200815161520/https://www.giro.com/p/aether-mips-road-bike-helmet/100000000300000099.html (5 pages).

Giro. Synthe Helmet. Accessed on Jul. 4, 2015. Available online at https://web.archive.org/web/20150703155418/http://www.giro.com/us_en/products/men/helmets/road.html/ (4 pages).

Pinkbike.com. POC Octal Helmet—Review. Nov. 26, 2014. Available online at https://www.pinkbike.com/news/poc-octal-helmet-review-2014.html (12 pages).

POC Ventral. Image of POC Ventral Air Spin Helmet as of Aug. 26, 2021. (1 page).

Schwinn UXO. Image of Schwinn UXO Multisport Adult Helmet with Sunglass Holder as of Aug. 26, 2021. (1 page).

European Patent Office. Extended European Search Report for application 22197398.5, dated Jan. 30, 2023.

* cited by examiner

BICYCLE HELMET WITH EYEWEAR RETENTION

CROSS-REFERENCE TO RELATED APPLICATIONS

This application claims priority to U.S. Provisional Application No. 63/248,810, filed Sep. 27, 2021, the entire contents of which are incorporated herein by reference.

BACKGROUND

The present disclosure relates generally to the field of bicycle helmets and specifically to a system for retaining eyewear on the helmet when the eyewear is not being used.

Helmets are typically worn by riders for various sports such as biking, motorsports, or the like. Different styles of helmets exist for different activities. While some activities require helmets having an attached visor or screen, other activities allow a rider to wear another type of eyewear. For example, some open-faced bicycle helmets allow a user to wear goggles or sunglasses that may be selectively removed from the user's face while riding.

DETAILED DESCRIPTION

Before any embodiments are explained in detail, it is to be understood that the present disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

According to an exemplary embodiment, a bicycle helmet adapted to be used with eyewear includes an impact-absorbing body, a resilient wiper, and an alignment feature. The impact-absorbing body has a convex exterior surface and a concave interior surface adapted to be positioned on a user's head. The impact-absorbing body further includes an aperture formed in the exterior surface and dimensioned to permit insertion of a portion of the eyewear into the aperture along an insertion axis. The resilient wiper is positioned at least partially in the aperture and arranged to engage the portion of the eyewear upon insertion into the aperture. The alignment feature defines at least a portion of the aperture and is oriented to guide the portion of the eyewear toward the resilient wiper.

According to another exemplary embodiment, a bicycle helmet and eyewear assembly includes an impact-absorbing body, a resilient wiper, and eyewear. The impact-absorbing body has a convex exterior surface and a concave interior surface adapted to be positioned on a user's head. The body also includes an aperture formed in the exterior surface and defines an insertion axis. The resilient wiper is positioned at least partially in the aperture, and the aperture has an aperture area at the location of the wiper. The wiper extends across at least 60% of the aperture area. The eyewear includes an arm positioned in the aperture that engages the resilient wiper.

According to another exemplary embodiment, an eyewear retainer adapted for selectively retaining eyewear to a bicycle helmet includes a frame. The frame is configured to be supported by a body of the bicycle helmet, and the frame defines an aperture that extends at least partially therethrough. The eyewear retainer further includes a guide and a wiper adjacent the guide. The guide is positioned at least partially in the aperture, and the wiper is adjacent the guide and protrudes into the aperture.

Figure 1:
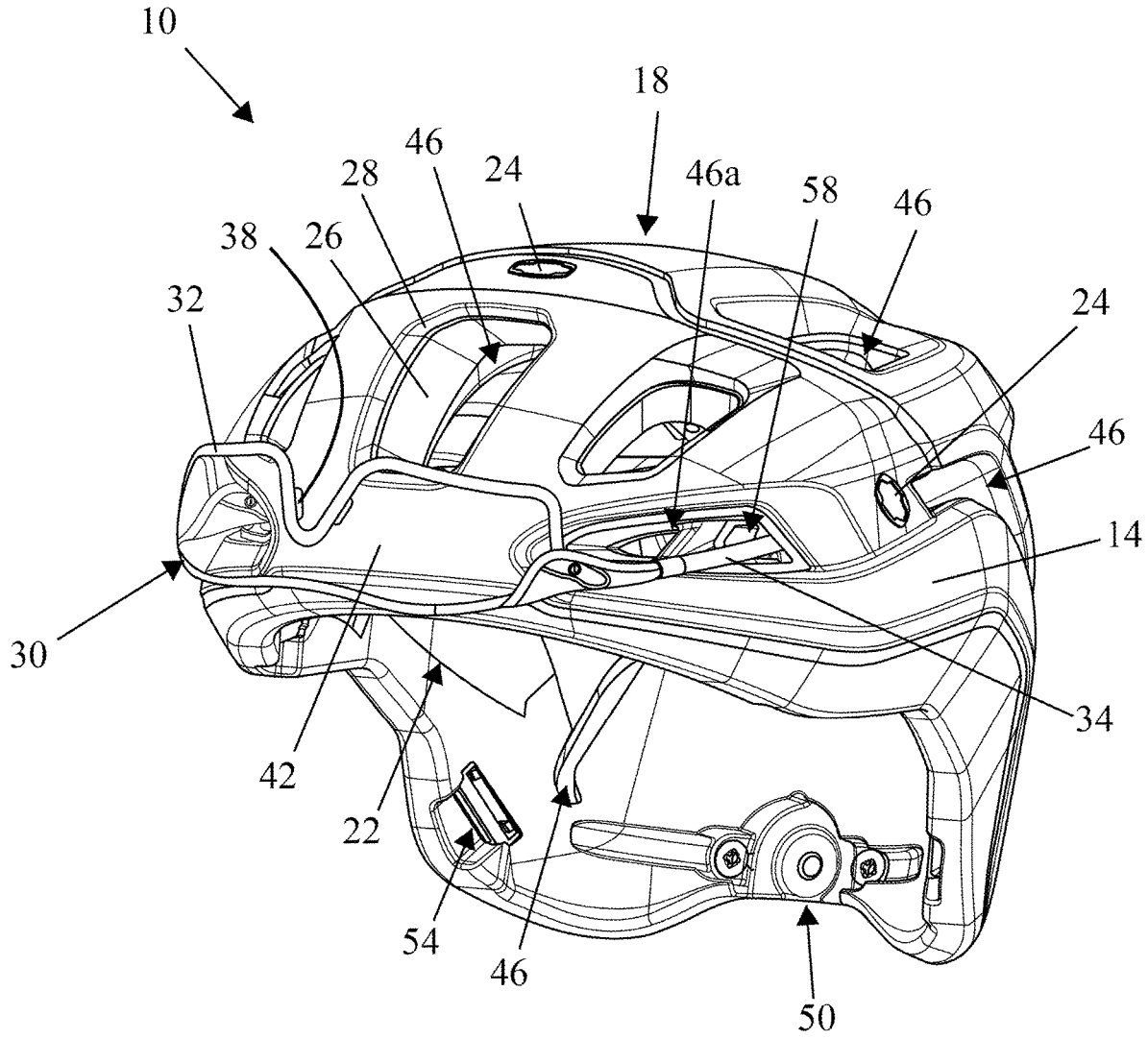
FIG. 1 is a perspective view of a helmet, according to an embodiment of the present disclosure, including eyewear inserted into and supported on the helmet.

According to an exemplary embodiment, FIG. 1 illustrates a helmet 10 (e.g., bicycle helmet) having an impact-absorbing helmet body 14 adapted to cover at least a portion of a rider's head. The helmet body 14 defines an exterior surface 18, and an interior surface 22 opposite the exterior surface 18 and that is adapted and shaped (e.g., domed) to be positioned over a user's head. In some embodiments, exterior surface 18 can be convex, and/or the interior surface 22 can be concave. The helmet 10 further includes one or more accessory mounts 24 positioned on the exterior surface 18. In some embodiments, the accessory mounts 24 may receive a visor or another riding accessory (e.g., shield, camera, or the like.).

The illustrated helmet body 14 includes an impact absorbing layer 26 and an outer shell 28 covering the impact absorbing layer 26. The impact absorbing layer 26 may be formed of a material such as expanded polystyrene (EPS) or the like, and defines the interior surface 22, and the outer shell 28 may be formed of a material such as polycarbonate, carbon fiber, or the like, and defines the exterior surface 18.

With continued reference to FIG. 1, the illustrated helmet 10 further includes a plurality of vents 46. One or more of the vents 46 extend through the body 14 to improve airflow to the user (e.g., to the user's head). Once the helmet 10 is placed or positioned on the user's head, an adjustable fit system may be adjusted to suit the user's preferences for helmet fit and tightness. Although not shown, the fit system may be positioned in a recess 50 in the body 14 and may include a dial, one or more tethers, a chin or underjaw strap, and/or one or more clips. Such clips, tethers, and/or straps may be positioned within the helmet 10 and extend through, for example, an opening 54 in the helmet 10.

Figure 2:
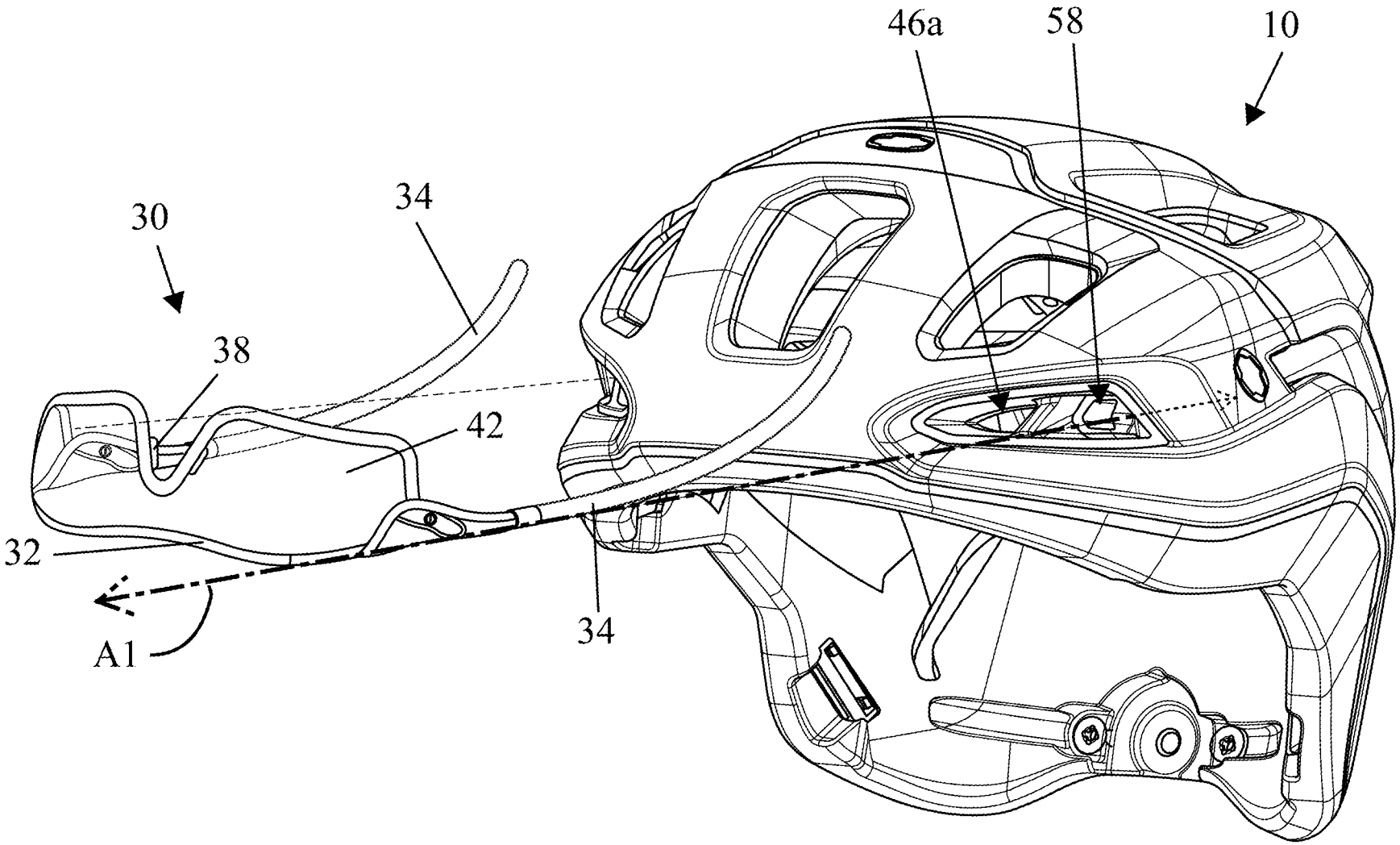
FIG. 2 is another perspective view of the helmet of FIG. 1, illustrating an example insertion path for the eyewear.

As illustrated in FIGS. 1 and 2, the helmet 10 is adapted to selectively receive eyewear 30, such as sunglasses, riding glasses, or the like. Further, the eyewear 30 can be selectively removed and/or separated from the helmet 10 when the eyewear 30 is received at the helmet 10. The illustrated eyewear 30 includes a frame 32 having opposing eyewear arms 34 typically supported on a user's ears, a nose piece 38, and some type of lens or shield 42. In the illustrated embodiment, each eyewear arm 34 is insertable into an aperture 58 formed in the exterior surface 18 and disposed in a forward-facing part of the helmet 10. In other embodiments, one or more of the apertures 58 may be disposed in other areas of the helmet 10, including a rearward-facing, upward facing, or side-facing part of the helmet 10. In the illustrated embodiment, the aperture(s) 58 is/are positioned in or adjacent to a forward vent 46*a* of the plurality of vents 46.

Referring to FIG. 2, the illustrated aperture 58 is dimensioned to permit insertion of a portion of the eyewear 30, particularly the eyewear arm 34, into the aperture 58 along an insertion axis A1. As illustrated in FIG. 2, the insertion axis A1 extends generally along a length of the helmet 10 between the forward-facing and rearward-facing parts of the helmet 10. In some embodiments, the insertion axis may be offset relative a front-to-rear direction such that the eyewear 30 may be inserted into the helmet 10 along another axis. For example, the eyewear 30 may be inserted into the helmet 10 along an axis that is substantially perpendicular to a curved portion of the exterior surface 18.

Figure 3:
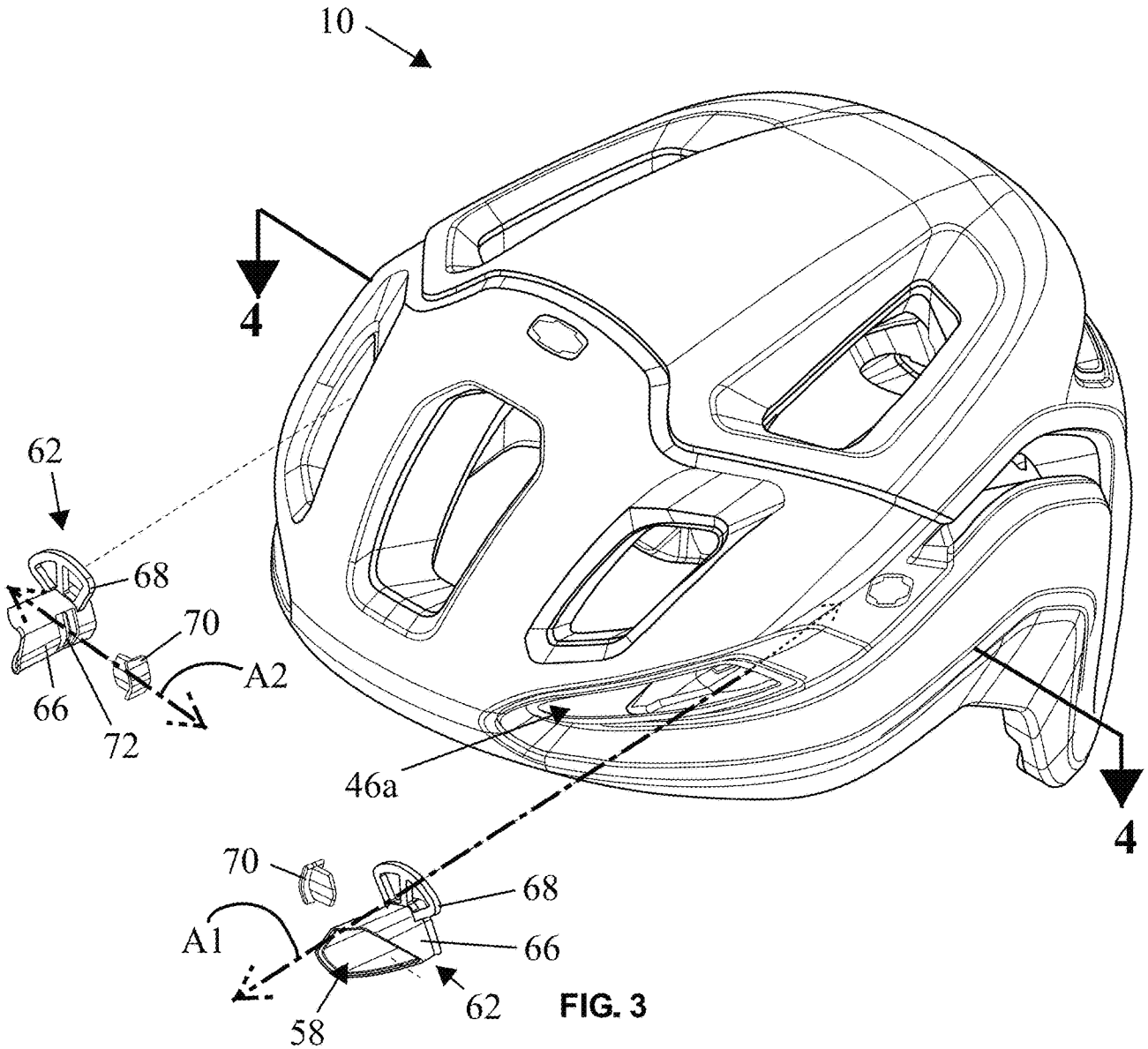
FIG. 3 is a partially exploded perspective view of an eyewear retention system supported in the helmet of FIG. 1.

With reference to FIG. 3, the illustrated helmet 10 further includes an eyewear retainer 62 adapted for selectively retaining the eyewear 30 to the helmet 10. In the illustrated embodiment, the retainer 62 is positioned in the forward vent 46*a* (e.g., during manufacturing of the helmet) 10 and is secured (e.g., mounted) in the body 14. In some embodiments, an expanded polystyrene (EPS) or moldable material may be used to form the helmet 10. In such embodiments, the material property of the EPS or other moldable material cooling, setting, or the like may be used to secure the retainer 62 in the body 14. In some embodiments, the retainer 62 may be selectively removed and inserted into the vent 46*a*. In some embodiments, the retainer 62 may be a stand-alone system that can be manufactured separately from the helmet 10 and selectively inserted into the helmet 10 for eyewear retention.

The illustrated eyewear retainer 62 includes a housing (e.g., frame) 66 that at least partially defines the aperture 58. In the illustrated embodiment, the retainer 62 also includes an anchor 68 extending from the housing 66, The anchor provides structure that is designed to be embedded (e.g., molded) into the impact-absorbing layer 26 in order to secure the eyewear retainer into the helmet 10.

The illustrated eyewear retainer 62 further includes a wiper 70 that extends at least partially into the aperture 58 along a wiper axis A2. The wiper axis A2 can be generally transverse (e.g., perpendicular) to the insertion axis A1, and the wiper axis A2 can form an angle with the insertion axis A1 (e.g., 90 degrees, 60 degrees, 45 degrees, 30 degrees, etc.). In many embodiments, the angle may be selected to achieve a desired retention force between the wiper 70 and the eyewear arm 34. For example, the wiper axis can be angled forward toward a front opening of aperture 58 or away from the front opening of aperture 58. In the illustrated embodiment, the wiper 70 is positioned to protrude through the housing 66 and across at least a portion of the aperture 58 (e.g., along the wiper axis A2), such that the wiper 70 will contact the eyewear arm 34 when the eyewear arm 34 is inserted into the aperture 58 (e.g., along the insertion axis A1). In general, the wiper 70 can be positioned to achieve a desired retention force between the wiper 70 and the eyewear arm 34. In these or other embodiments, the wiper 70 can be configured so that a desired surface area of the wiper 70 contacts the eyewear arm 34 in order to achieve a desired retention force between the wiper 70 and the eyewear arm 34.

Figure 4:
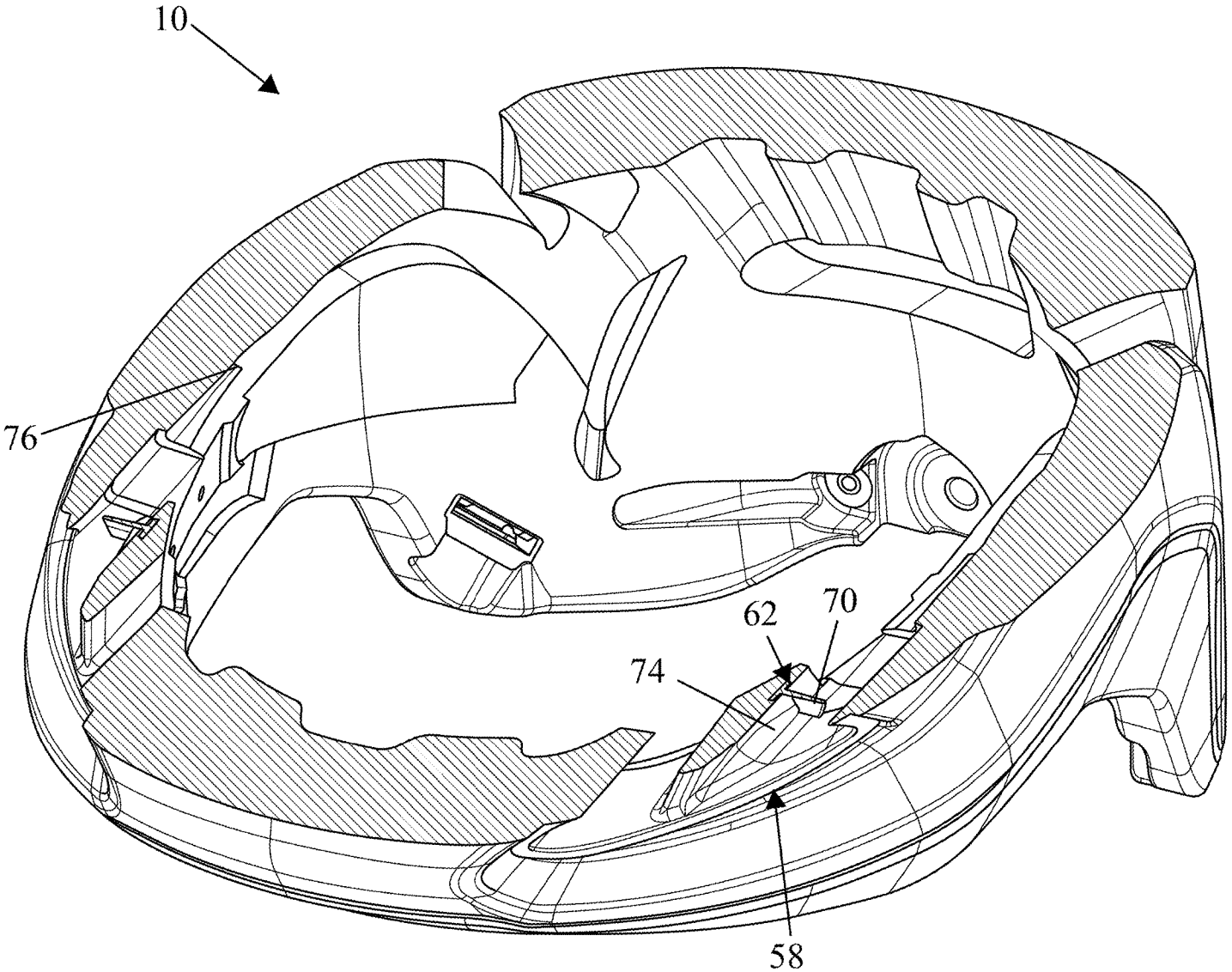
FIG. 4 is a cross-sectional perspective view of the helmet of FIG. 1, taken through the section line 4-4 of FIG. 3, illustrating a position of the eyewear retention system in the helmet.

With reference to FIG. 4, at least a portion of the illustrated wiper 70 is formed of resilient material such as rubber, silicone, of the like. In some embodiments, the material and/or surfaces of the wiper 70 may have a sticky or gripping texture that may, for example, increase a friction force between the wiper 70 and the eyewear arm 34. In these or other embodiments, the material and/or surfaces of the wiper 70 can be selected to achieve a desired retention force between the wiper 70 and the eyewear arm 34.

In the illustrated embodiment, the retainer 62 further includes a guide 74 (i.e., alignment feature), that is positioned and oriented to guide a portion of the eyewear 30 (e.g., the eyewear arm 34) toward the wiper 70. In some embodiments, the helmet 10 may include a stop member 76 (e.g., wall) formed in the body 14 that is configured to constrain the eyewear arm 34 from moving too far into the helmet 10. In other embodiments, stop member 76 can be omitted or can included for purposes other than constraining the eyewear arm 34 from moving too far into the helmet 10.

Figure 5:
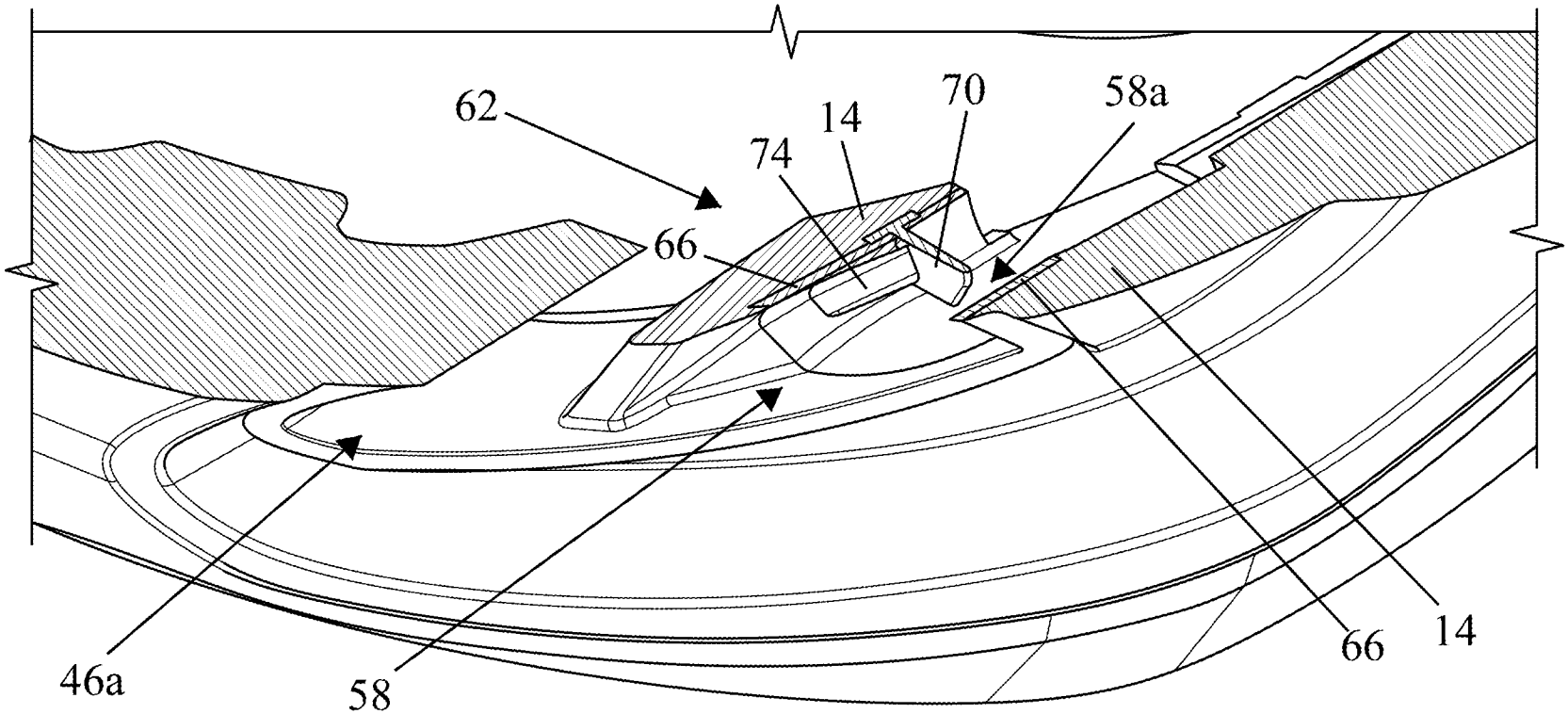
FIG. 5 is an enlarged view of a portion of the cross-sectional perspective view of FIG. 4, illustrating one side of the eyewear retention system in the helmet.

With specific reference to FIG. 5, the illustrated guide 74 is integrally formed with the housing 66. In some embodiments, the guide 74 is fastened to the housing 66. The guide 74 may be ramped or sloped such that a user may easily locate a part of the guide 74 with the eyewear arm 34 and slide the eyewear arm 34 against the guide 74 into contact with the wiper 70. In other embodiments, the guide 74 may be generally straight. In some embodiments, the guide 74 may be another shape suited for aligning the eyewear arm 34 with the wiper 70. As shown in FIG. 5, the housing 66 of the retainer 62, along with the anchor 68 (if included), is supported by the body 14 of the helmet 10 within the forward vent 46*a*.

Figure 6:
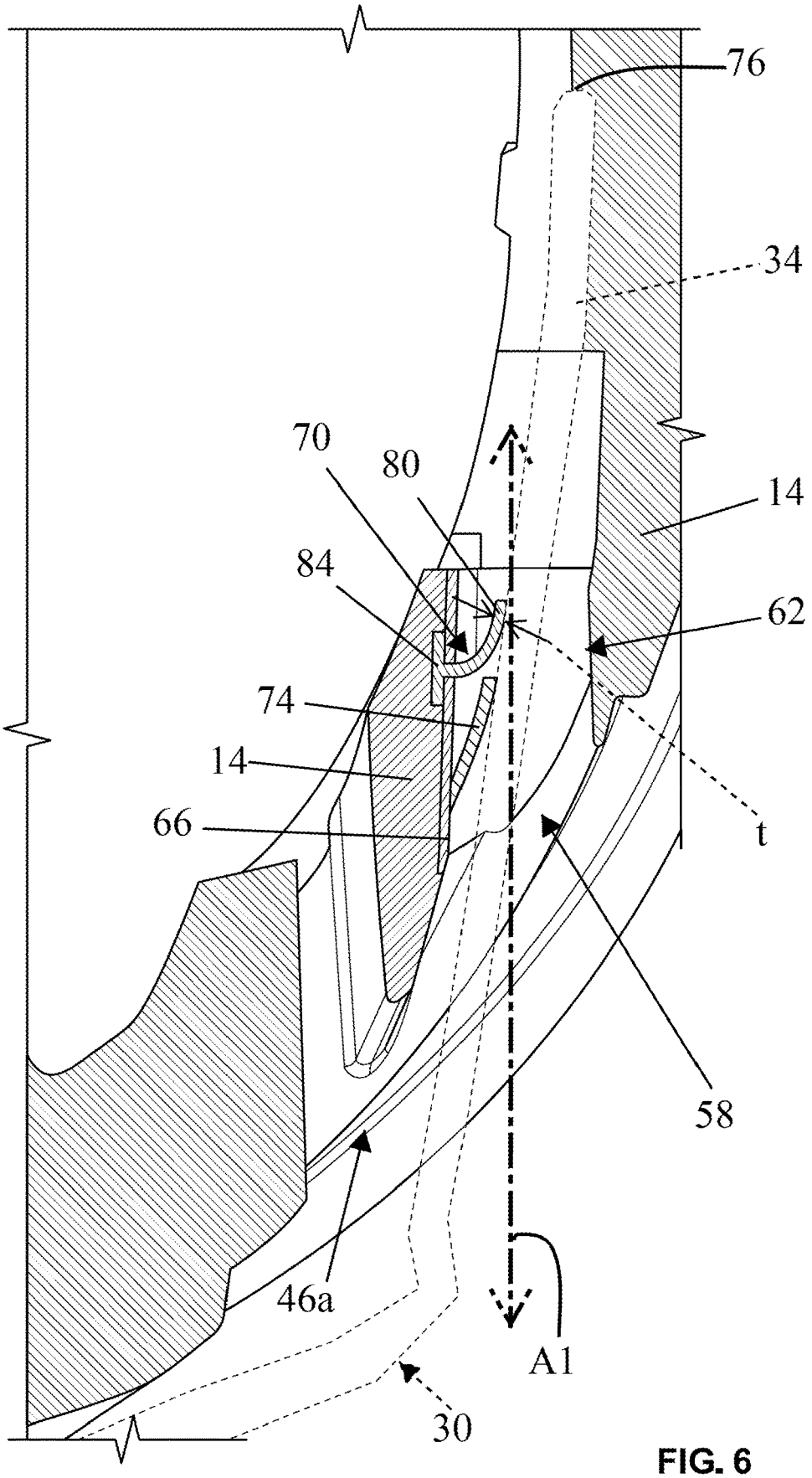
FIG. 6 is a top view of the enlarged cross-sectional perspective view of FIG. 5, illustrating an arm of the eyewear received in a part of the eyewear retention system and a wiper of the eyewear retention system in a deflected position.

FIG. 5 illustrates the wiper 70 in a first, non-deformed position in which the eyewear arm 34 (not shown) is not positioned in the aperture 58, and FIG. 6 illustrates the wiper 70 in a second, deformed or "deflected" position in which the eyewear arm 34 is positioned in the aperture 58 and contacts the wiper 70 to deflect an end of the wiper 70. The wiper 70 resiliently/elastically deflects principally along the insertion axis A1. As shown in FIG. 6, the guide 74 guides the eyewear arm 34 to initially contact the wiper 70 before bending the wiper 70 backward. The gripping surface of the wiper 70 discussed above, and/or the resilience of the wiper 70 itself, frictionally holds the wiper 70 in a retained position in which the eyewear 30 is secured to the helmet 10.

As further shown in FIG. 6, the illustrated wiper 70 includes a wiper arm 80 and a base 84. The base 84 constrains the wiper 70 in position as the eyewear arm 34 contacts (e.g., deflects) the wiper arm 80. In the illustrated embodiment, the wiper 70 is secured to the retainer 62 via the base 84. On one side, the base 84 is pressed to the housing 66 of the retainer 62. On an opposing side, the base 84 is constrained by the body 14. That is, the base 84 is sandwiched between the body 14 and the housing 66 to retain the entire wiper 70 in place. Because the wiper 70 is flexible, a free end of the wiper arm 80 that is contacted by eyewear 30 will be deflected while the base 84 maintains the rest of the wiper 70 in a generally fixed position relative to the rest of the helmet. Other embodiments may include different shapes for the base 84 and wiper arm 80 than that illustrated. In some embodiments, the wiper 70 may be removable and/or replaceable. For example, the retainer 62 may be designed to be removed from the aperture 58, and the wiper 70 may be replaced. In these or other embodiments, wiper 70 can be selected (e.g., from multiple wipers) to achieve a desired retention force between the wiper 70 and the eyewear arm 34.

In the illustrated embodiment, the housing 66 supports the wiper 70 and may be formed/made of a first material, such a rigid plastic, lightweight aluminum, carbon fiber, or the like. The wiper 70 may be formed/made of a second (e.g., different) material, such as the flexible or deformable material discussed above. In some embodiments, the material of the housing 66 has a higher modulus of elasticity than the material of the wiper 70. Stated another way, the wiper 70 may be more flexible than the housing 66 supporting the wiper 70.

Figure 7:
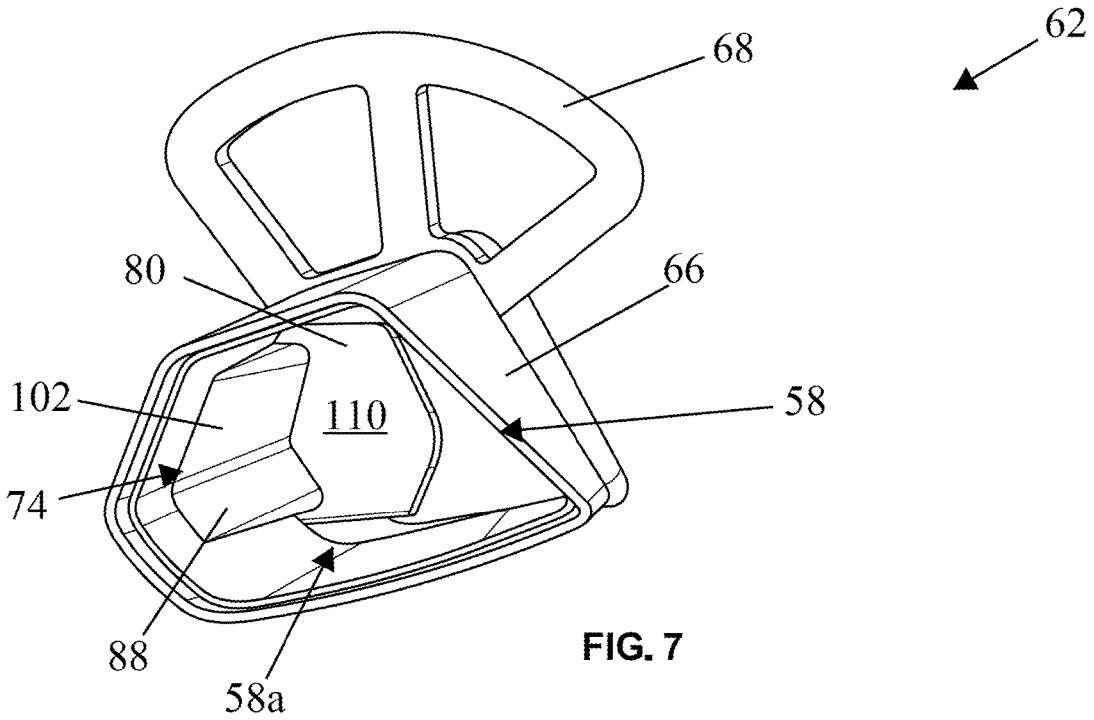
FIG. 7 is an enlarged isolated perspective view of the eyewear retention system, illustrating a housing of the eyewear retention system.
Figure 8:
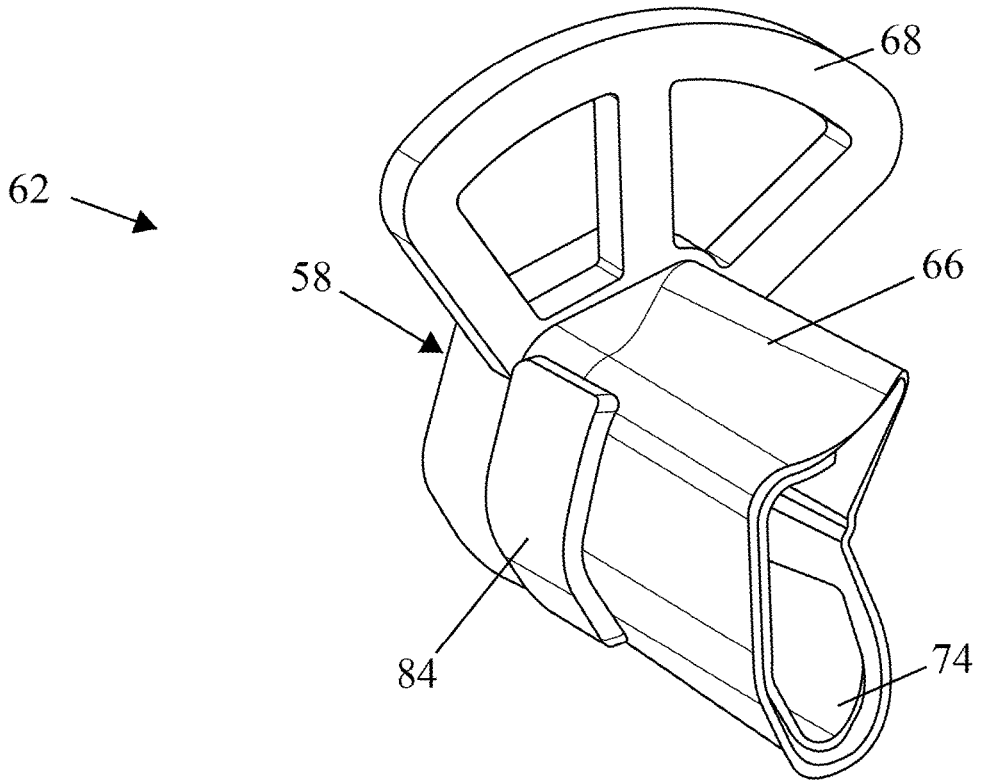
FIG. 8 is another enlarged isolated perspective view of the eyewear retention system illustrating the housing of the eyewear retention system.
Figure 9:
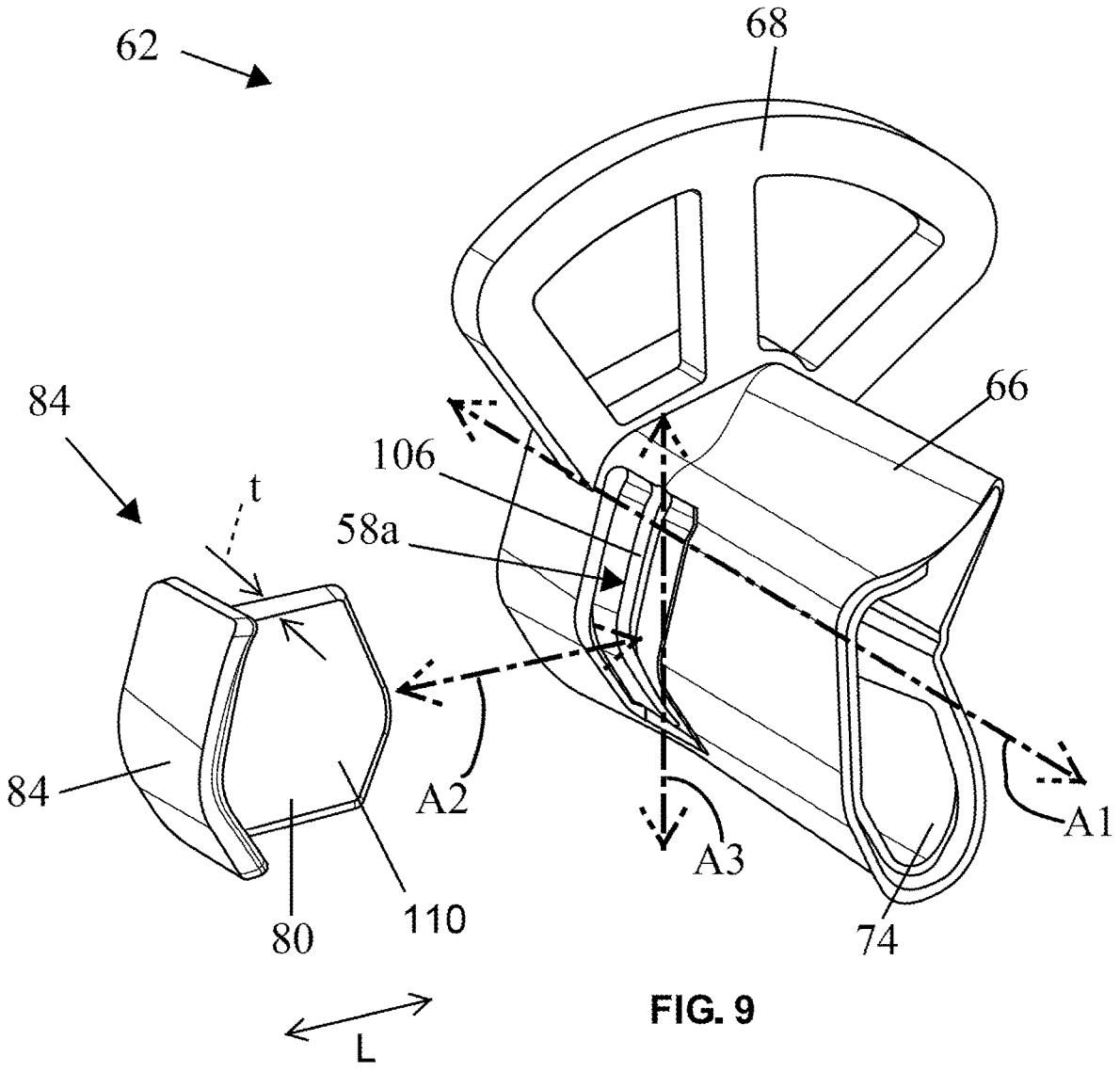
FIG. 9 is an enlarged exploded perspective view of the eyewear retention system, illustrating the wiper of the eyewear retention system separated from the housing of the eyewear retention system.

Referring now to FIGS. 7-9, the illustrated guide 74 includes two guide surfaces 88, 102 (e.g., sloped guiding surfaces) that converge in a direction substantially toward the wiper 70. In the illustrated embodiment, the two guide surfaces 88, 102 are non-coplanar. As best shown in FIG. 7, the two guide surfaces 88, 102 converge to guide the eyewear arm 34 of the eyewear 30 toward a central region of the wiper 70. Therefore, the guide surfaces 88, 102 also assist a user with centrally inserting the eyewear arm 34 against the wiper 70.

Referring now to FIG. 9, the illustrated housing 66 of the retainer 62 includes a slot 106 that extends through the housing 66 and is sized to receive the wiper arm 80. In the illustrated embodiment, the slot 106 is further sized smaller than the base 84 such that the base 84 will not pass through the slot 106.

With continued reference to FIG. 9, the illustrated slot 106 extends along and defines a slot axis A3 that is generally transverse (e.g., perpendicular) to the wiper axis A2 and also transverse (e.g., perpendicular) to the insertion axis A1. The slot 106 allows an exposed portion 110 (seen for example in FIGS. 7 and 9) of the wiper arm 80 to extend through the housing 66 along the wiper axis A2 and to extend into and be exposed within the aperture 58. In some embodiments the entire wiper arm 80 forms the exposed portion 110. In the illustrated embodiment, a thickness "t" (seen for example in FIG. 9 and measured along the axis A1) of the wiper arm 80 is relatively thin compared to an overall length "L" of the exposed portion 110 (as measured along the wiper axis A2). In some embodiments, the thickness "t" of the wiper arm 80 may be less than approximately 40% of the length of the exposed portion 110. In the illustrated embodiment, the thickness "t" of the wiper arm 80 is less than approximately 20% of the length of the exposed portion 110. In many embodiments, the thickness "t" and overall length "L" may be selected to achieve a desired retention force between the wiper 70 and the eyewear arm 34. For example, reducing the thickness "t" and/or the overall length "L" may lower the retention force by making the wiper 70 less resilient and/or by reducing the contact surface area of the wiper 70. Additionally, a width "W" of the wiper 70 along the slot axis A3 may be selected to achieve a desired retention force between the wiper 70 and the eyewear arm 34. Similar to the overall length "L," reducing the width "W" may lower the retention force by reducing the contact surface area of the wiper 70.

Figure 10:
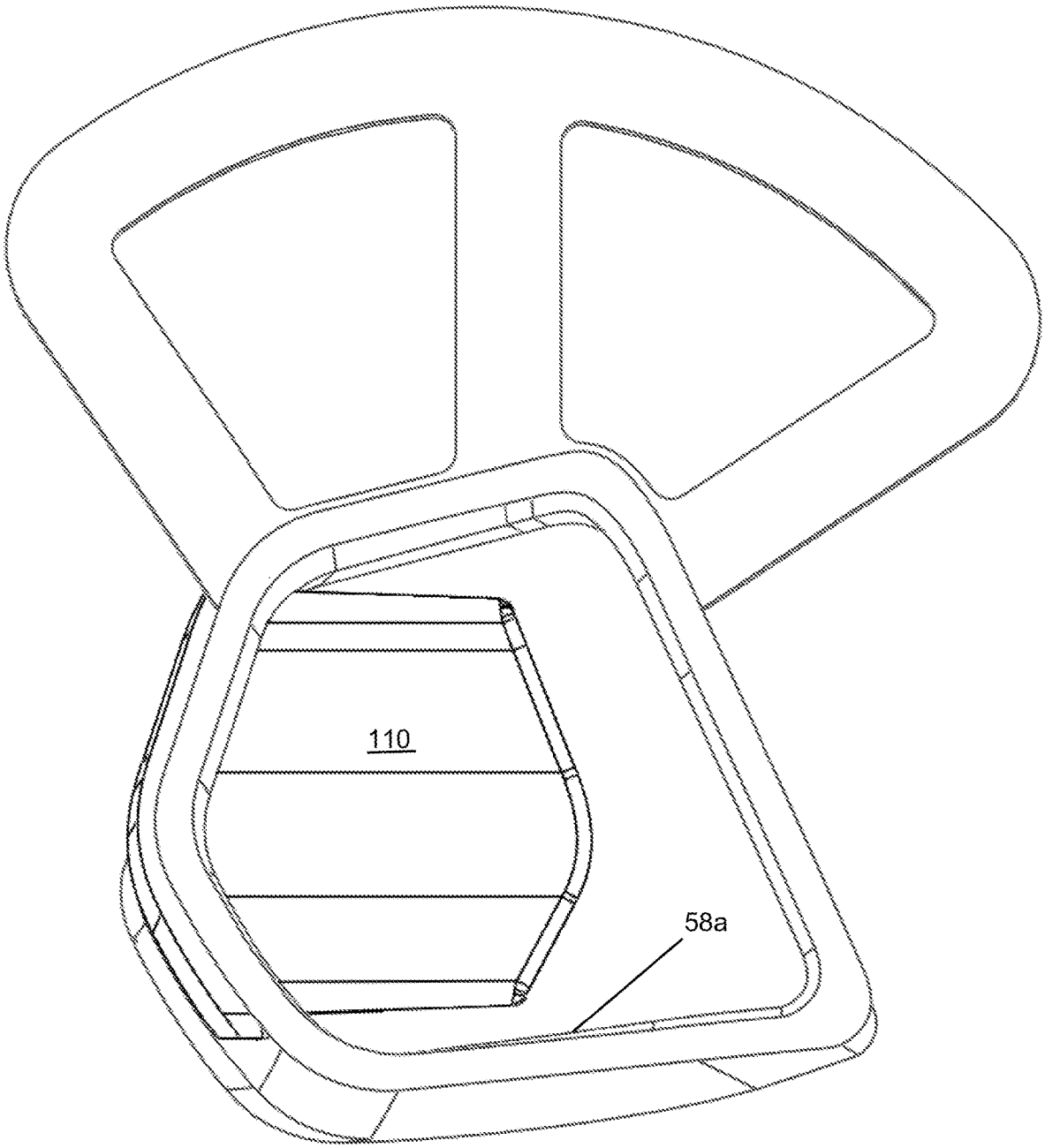
FIG. 10 is a rear view of the wiper and the housing of the eyewear retention system.

With reference to FIGS. 5, 7, and 9, the illustrated wiper arm 80 extends along the axis A2 and into a segment 58*a* of the aperture 58 within the housing 66. The segment 58*a* defines an aperture area (e.g., an area defined by a cross section of the aperture 58 at the location where the wiper arm 80 extends into the aperture 58 along the axis A2) that is about 0.2 square inches. Referring to FIG. 10, the exposed portion 110 of the illustrated wiper 70 has a wiper area that is about 0.06 square inches and extends across at least 10% of the aperture area (e.g., at least 20% of the aperture area, about 30% of the aperture area), such that the exposed portion 110 of the wiper 70 will contact the eyewear arm 34 when inserted into the aperture 58.

Clause 1: A bicycle helmet adapted to be used with eyewear includes an impact-absorbing body having an exterior surface and an interior surface opposite the exterior surface and adapted to be positioned over a user's head, the body including an aperture formed in the exterior surface and dimensioned to permit insertion of a portion of the eyewear into the aperture along an insertion axis. The bicycle helmet also includes a resilient wiper positioned at least partially in the aperture and arranged to engage the portion of the eyewear when the portion of the eyewear is inserted into the aperture. The bicycle helmet also includes an alignment feature defining at least a portion of the aperture and oriented to guide the portion of the eyewear toward the resilient wiper.

Clause 2: The bicycle helmet of clause 1, wherein the alignment feature includes two non-coplanar guide surfaces that converge in a direction substantially toward the resilient wiper.

Clause 3: The bicycle helmet of clause 2, wherein the two non-coplanar guide surfaces are adapted to guide the portion of the eyewear toward a central region of the resilient wiper.

Clause 4: The bicycle helmet of any of the preceding clauses, further comprising a wiper support that supports the wiper, wherein the wiper support comprises a first material and the wiper comprises a second material, and wherein the first material has a higher modulus of elasticity than the second material.

Clause 5: The bicycle helmet of clause 4, wherein the alignment feature is formed by a portion of the wiper support.

Clause 6: The bicycle helmet of clause 4 or clause 5, wherein the wiper support includes a slot, and wherein the resilient wiper is positioned in the slot.

Clause 7: The bicycle helmet of clause 6, wherein the slot defines an axis that is transverse to the insertion axis.

Clause 8: The bicycle helmet of any of the preceding clauses, wherein the alignment feature includes a sloped guiding surface that guides the portion of the eyewear away from the concave interior as the portion of the eyewear is inserted into the aperture.

Clause 9: The bicycle helmet of any of the preceding clauses, wherein the aperture has an aperture area at the location of the wiper, and wherein the wiper has an exposed portion that extends across at least 20% of the aperture area.

Clause 10: The bicycle helmet of clause 9, wherein the exposed portion has a length along an axis that is transverse to the insertion axis, wherein the wiper has a thickness in the direction of the insertion axis that is less than 20% of the length of the exposed portion.

Clause 11: The bicycle helmet of any of the preceding clauses, wherein the impact-absorbing body includes a vent, and wherein the alignment feature is positioned within the vent of the bicycle helmet.

Clause 12: A bicycle helmet and eyewear assembly includes an impact-absorbing body having an exterior surface and an interior surface opposite the exterior surface and adapted to be positioned over a user's head, the body including an aperture formed in the exterior surface and defining an insertion axis. The bicycle helmet also includes a resilient wiper positioned at least partially in the aperture, wherein the aperture has an aperture area at the location of the wiper, and wherein the wiper extends across at least 20% of the aperture area. The bicycle helmet also includes eyewear including an arm positioned in the aperture and engaging the resilient wiper.

Clause 13: The bicycle helmet of clause 12, wherein a length of the wiper is exposed in the aperture, and wherein the wiper has a thickness in the direction of the insertion axis that is less than 20% of the length of the wiper exposed in the aperture.

Clause 14: The bicycle helmet of clause 12 or clause 13, further comprising a wiper support that supports the wiper, wherein the wiper support comprises a first material and the wiper comprises a second material, and wherein the first material has a higher modulus of elasticity than the second material.

Clause 15: The bicycle helmet of clause 14, wherein the wiper support includes a slot, and wherein the resilient wiper is positioned in the slot.

Clause 16: The bicycle helmet of clause 15, wherein the slot defines an axis that is transverse to the insertion axis.

Clause 17: An eyewear retainer adapted for selectively retaining eyewear to a bicycle helmet includes a frame configured to be supported by a body of the bicycle helmet, the frame defining an aperture extending at least partially therethrough. The eyewear retainer also includes a guide positioned at least partially in the aperture, and a wiper adjacent the guide and protruding into the aperture.

Clause 18: The eyewear retainer of clause 17, wherein the wiper is at least partially resiliently and elastically deformable, and wherein the wiper is configured to be resiliently and elastically deformed by a portion of the eyewear.

Clause 19: The eyewear retainer of clause 17 or clause 18, wherein at least a portion of the wiper extends through the frame.

Clause 20: The eyewear retainer of any of clauses 17-19, wherein a portion of the aperture defines an aperture area, and wherein at least a portion of the wiper extends into the aperture area to block the aperture along an insertion axis.

Various features of the disclosure are set forth in the following claims.

What is claimed is:

1. A bicycle helmet adapted to be used with eyewear, the helmet comprising:

an impact-absorbing body having an exterior surface and an interior surface opposite the exterior surface and adapted to be positioned over a user's head, the body including an aperture formed in the exterior surface and dimensioned to permit insertion of a portion of the eyewear into the aperture along an insertion axis;

a resilient wiper positioned at least partially in the aperture and arranged to engage the portion of the eyewear when the portion of the eyewear is inserted into the aperture; and an alignment feature defining at least a portion of the aperture and oriented to guide the portion of the eyewear toward the resilient wiper.

2. A bicycle helmet as claimed in claim 1, wherein the alignment feature includes two non-coplanar guide surfaces that converge in a direction substantially toward the resilient wiper.

3. A bicycle helmet as claimed in claim 2, wherein the two non-coplanar guide surfaces are adapted to guide the portion of the eyewear toward a central region of the resilient wiper.

4. A bicycle helmet as claimed in claim 1, further comprising a wiper support that supports the wiper, wherein the wiper support comprises a first material and the wiper comprises a second material, and wherein the first material has a higher modulus of elasticity than the second material.

5. A bicycle helmet as claimed in claim 4, wherein the alignment feature is formed by a portion of the wiper support.

6. A bicycle helmet as claimed in claim 4, wherein the wiper support includes a slot, and wherein the resilient wiper is positioned in the slot.

7. A bicycle helmet as claimed in claim 6, wherein the slot defines an axis that is transverse to the insertion axis.

8. A bicycle helmet as claimed in claim 1, wherein the alignment feature includes a sloped guiding surface that guides the portion of the eyewear away from a concave interior as the portion of the eyewear is inserted into the aperture.

9. A bicycle helmet as claimed in claim 1, wherein the aperture has an aperture area at the location of the wiper, and wherein the wiper has an exposed portion that extends across at least 20% of the aperture area.

10. A bicycle helmet as claimed in claim 9, wherein the exposed portion has a length along an axis that is transverse to the insertion axis, wherein the wiper has a thickness in the direction of the insertion axis that is less than 20% of the length of the exposed portion.

11. A bicycle helmet as claimed in claim 1, wherein the impact-absorbing body includes a vent, and wherein the alignment feature is positioned within the vent of the bicycle helmet.

12. A bicycle helmet and eyewear assembly comprising:

an impact-absorbing body having an exterior surface and an interior surface opposite the exterior surface and adapted to be positioned over a user's head, the body including an aperture formed in the exterior surface and defining an insertion axis;

a resilient wiper positioned at least partially in the aperture, wherein the aperture has an aperture area at the location of the wiper, and wherein the wiper extends across at least 20% of the aperture area; and eyewear including an arm positioned in the aperture and engaging the resilient wiper.

13. A bicycle helmet as claimed in claim 12, wherein a length of the wiper is exposed in the aperture, and wherein the wiper has a thickness in the direction of the insertion axis that is less than 20% of the length of the wiper exposed in the aperture.

14. A bicycle helmet as claimed in claim 12, further comprising a wiper support that supports the wiper, wherein the wiper support comprises a first material and the wiper comprises a second material, and wherein the first material has a higher modulus of elasticity than the second material.

15. A bicycle helmet as claimed in claim 14, wherein the wiper support includes a slot, and wherein the resilient wiper is positioned in the slot.

16. A bicycle helmet as claimed in claim 15, wherein the slot defines an axis that is transverse to the insertion axis.

* * * * *